United States Patent [19]

Smutny

[11] 4,046,224

[45] Sept. 6, 1977

[54] APPARATUS FOR LUBRICATING THE GRIPPER BAND OF A SHUTTLELESS LOOM

[75] Inventor: Viktor Smutny, Wetzikon, Switzerland

[73] Assignee: Ruti Machinery Works Ltd., Ruti, ZH, Switzerland

[21] Appl. No.: 639,186

[22] Filed: Dec. 9, 1975

[30] Foreign Application Priority Data

Dec. 24, 1974 Switzerland ..... 17253/74

[51] Int. Cl.[2] ..... F16N 7/12; F16N 7/24

[52] U.S. Cl. ..... 184/15 R; 139/45

[58] Field of Search ..... 139/449, 45; 184/15 R, 184/15 B, 16, 17, 19, 22, 25, 65, 102

[56] References Cited

U.S. PATENT DOCUMENTS

| | | | |
|---|---|---|---|
| 849,784 | 4/1907 | Giles | 139/45 |
| 1,794,725 | 3/1931 | Minor | 184/17 |
| 2,238,341 | 4/1941 | Reinhardt | 184/15 B |
| 2,308,872 | 1/1943 | Foster | 184/17 |
| 2,810,403 | 10/1957 | Sanderson | 139/449 |
| 2,868,505 | 1/1959 | Gurley | 184/17 |
| 2,909,150 | 10/1959 | Ungerer | 184/17 |
| 2,910,043 | 10/1959 | Borden | 184/17 |
| 3,221,775 | 12/1965 | Boley | 139/45 |
| 3,672,405 | 6/1972 | Flamand | 139/449 |

*Primary Examiner*—Samuel W. Engle
*Assistant Examiner*—Thomas H. Webb
*Attorney, Agent, or Firm*—Donald D. Denton

[57] ABSTRACT

Apparatus for lubricating and cooling the gripper band on a shuttleless loom in which a roller containing lubricant is resiliently biased against one side of the gripper band and driven by the movement of the gripper band.

4 Claims, 4 Drawing Figures

APPARATUS FOR LUBRICATING THE GRIPPER BAND OF A SHUTTLELESS LOOM

BACKGROUND OF THE INVENTION

In a shuttleless-type loom the filling yarn is introduced by means of a gripper arranged at the end of a flexible band up to the center of the shed and is transferred there to a second gripper which is introduced into the shed from the opposite side of the loom, also on the end of a flexible band. The loom therefore has one band wheel on each of its opposite sides, a separate flexible band being fastened on each of them at its one end so that the band, upon rotation of the band wheel, is unwound from and wound onto the band wheel with constantly changing direction of rotation. Upon the unwinding, the flexible band is pushed from its rear fastened end and must therefore be supported by band shoes arranged along the circumference of the band wheel. Furthermore, between the band wheel and the shed the flexible band, which is moved tangentially away from the band wheel, must also be guided. As a result of the friction occurring at the band shoes and at the guide, the gripper band heats up. In known arrangements therefore lubricant has been added drop by drop to the band or else the gripper band has been caused to move through a material impregnated with lubricant, which did not provide satisfactory action since the lubrication is very uneven unless constant control is exercised. Lubrication in itself is not desirable due to the danger of the fabric being woven being soiled thereby, but since the band becomes too hot without lubrication it cannot be dispensed with. Furthermore, there has also been proposed lubrication by means of a wick which dips into a supply container, which however is uncertain in its action since the wick is easily carbonized due to the high temperature produced by the friction.

SUMMARY OF THE INVENTION

It has been found that the problems heretofore set forth can be satisfactorily solved if a cooling action is produced simultaneously with the application of a very thin film of lubricant onto the band. In order to achieve this, the invention provides a device for lubricating the gripper band of a shuttleless-type loom or weaving machine, which is characterized by a roller the axis of which is transverse to the direction of movement of the gripper band and which consists of absorptive material suitable for impregnation with lubricant, the roller being pressed by spring action against one side of the gripper band and being driven by the latter. The material of the roller may suitably consist of felt and the shaft of the roller is furthermore hollow and provided with radial bore holes and connected to a supply container for lubricant via a conduit in which there is contained a shut-off valve in order to interrupt the feeding of the lubricant, so that during long periods of standstill of the loom the feeding of lubricants can be interrupted. From the supply container the lubricant passes through the hollow shaft and the radial bore holes into the felt roller which produces a film of lubricant with good cooling action on the gripper band.

BRIEF DESCRIPTION OF THE DRAWINGS

These and other objects of the invention will become apparent from the detailed description of the preferred embodiments of the invention and the drawings, in which.

DESCRIPTION OF PREFERRED EMBODIMENTS

Figure 1:
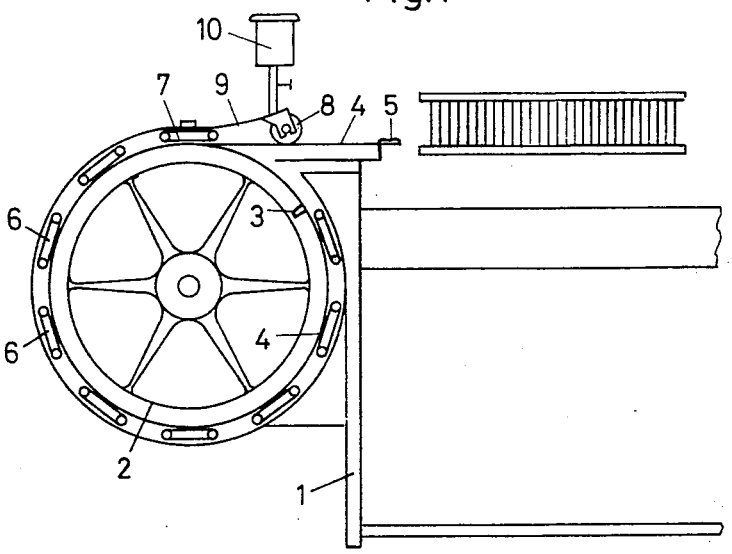
FIG. 1 is a vertical view showing schematically a gripper drive, arranged on the left-hand side of a weaving machine, provided with a lubricating device in accordance with the invention.

The loom whose left-hand side is shown schematically in FIG. 1 has attached laterally on a weaving machine frame 1 a band wheel 2 which is turned alternately clockwise and counterclockwise by a drive (not shown) coupled to the drive mechanism for the weaving process, whereby the filling section band 4 fastened with its one end at 3 to the circumference of the band wheel is unwound from the band wheel and wound onto it. Upon the unwinding from the band wheel, a gripper 5 arranged on the free end of the band enters into the shed of the loom together with the filling yarn. The gripper band 4 is in this connection supported by band shoes 6 which are arranged along the circumference of the band wheel to assure a tangential movement of the band as it leaves the circumference of the wheel.

At the uppermost point of the band wheel where the gripper band moves tangentially towards the side, a lubricating roller 8 having a felt body 15 is so arranged on a guide plate 7 that the roller is pressed lightly against the top of the gripper band 4 by means of two leaf or wire spring biasing means 9 which act on the two ends of the shaft of the roller. The lubricant is gravity fed to the roller from a supply container 10 arranged above the roller.

Figure 2:
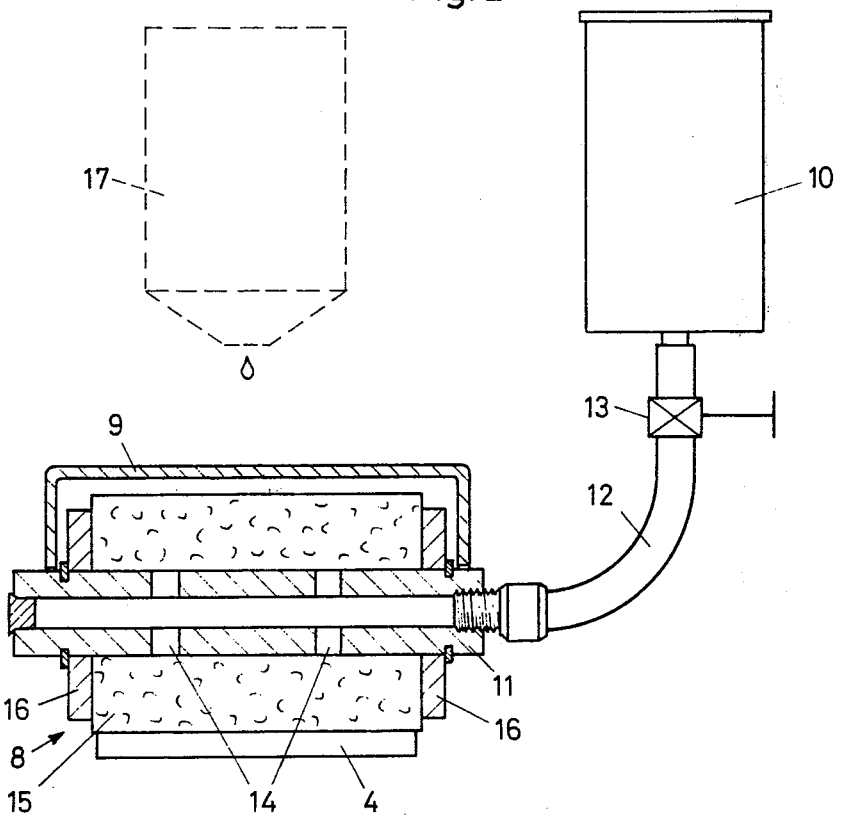
FIG. 2 is a view partly in longitudinal section taken transverse to the direction of movement of the gripper band through the lubricating device, seen on a larger scale.

The roller 8 shown in longitudinal direction in FIG. 2 has a hollow shaft 11 which is closed at one end and connected at the other end to a feed line 12 which is connected with the supply container 10 which contains the lubricant. A shut-off or regulatory valve 13 in a feed line or conduit 12, which operatively connects the container to the roller, serves as a means to interrupt the feeding of the lubricant in case of long periods of shutdown.

It will be appreciated that the valve 13 provides for interrupting and regulating the flow of lubricant to the roller body.

The hollow shaft 11 has radial bore holes 14 for the passage of the lubricant into the felt roller body 15 arranged rotatably on the shaft, the felt roller body giving the lubricant off to the surface of the gripper band 4 as the felt body rolls in contact with the surface of the band 4. Instead of the lubricant being fed with direct flow it can also be fed to supply the felt roller body by means of a wick which is inserted in the bore of the shaft 11 and is in communication with the container 10, this corresponding to the embodiment in accordance with FIG. 2 but containing in addition a wick. Side discs 16 fastened by circular clips to the shaft rest against both ends of the felt roller body 15.

In a simplified embodiment a variant of the apparatus may have a supply container 17, shown in dash line in FIG. 2, positioned and arranged above the roller and having means for providing the dripping of lubricant onto the felt roller body. In this case, the shaft need not be hollow.

Figure 3:
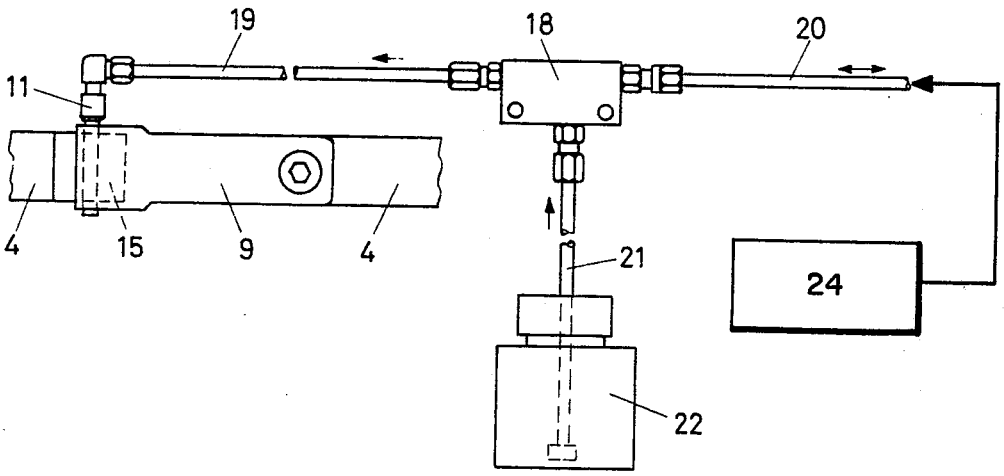
FIG. 3 is a top plan view of another embodiment of the lubricating device of the invention in which the device is connected to the central lubrication system.
Figure 4:
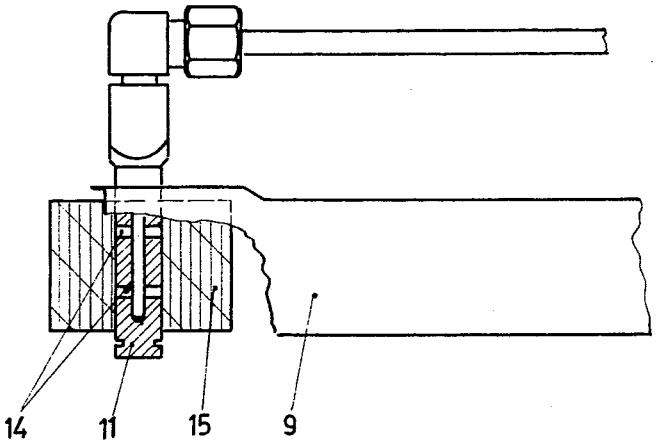
FIG. 4 is a partial view of the embodiment shown in FIG. 3 showing in detail radial holes for lubricant passage into a felt roller.

In a still further embodiment of the lubricating device which is shown diagrammatically in FIG. 3, the shaft 11 of the roller 15 is also hollow and provided with radial bore holes 14 and connected via a first conduit 19 to a reciprocating pump 18. This reciprocating pump is connected via a second conduit 20 to the central lubricating system 24 of the loom. The reciprocating pump is in this case actuated by the pressure surges of the central lubrication and pumps and meters the required quantity of oil from a container 22 via a third conduit 21 connecting said container with the pump and the second conduit 19 to the shaft of the roller body 15.

The advantage of the apparatus above described, over the previously known solutions, is that by means of the roller a measured dosage of the lubricant is delivered and a uniform distribution thereof over the width of the band can be obtained with an extremely thin film of lubricant being applied. The apparatus described above thus produces a reduction in the temperature at the gripper band from about 180° C. to about 60° to 80° C., thus effecting a substantial cooling of the band. It will be appreciated that the maintenance and monitoring of the apparatus of this invention can be limited to a single refilling of the storage container once a week.

It will also be appreciated that various changes and/or modifications may be made within the skill of the art without departing from the spirit and scope of the invention illustrated, described, and claimed herein.

What is claimed is:

1. Apparatus for lubricating a gripper band carrying an oscillating weft yarn inserting element for weft yarn insertion in the shed of a shuttleless loom, comprising a roller body of absorptive material suitable for impregnation with lubricant, a shaft supporting said roller body, said shaft being hollow and provided with radial holes, said lubricant being fed to said hollow shaft and therefrom through said holes to said absorptive material, said shaft being disposed transversely to the direction of movement of the gripper band, and said roller body being adapted to be operatively connected to the loom, resiliently biased against the upper side of the gripper band and driven by it.

2. The apparatus according to claim 1 in which the material forming the roller body consists of felt.

3. The apparatus according to claim 1 in which said hollow shaft is connected to a lubricant storage container by a conduit having a regulatory valve positioned therein for interrupting lubricant flowing from said storage container through said conduit and into said hollow shaft to said roller body, said valve being capable of controlling the amount of lubricant that flows or stopping it.

4. The apparatus according to claim 1 in which said hollow shaft is connected to a reciprocating pump by a first conduit, said reciprocating pump being connected to a central lubricating system of the loom by a second conduit having lubricant pressure surges therein during operation of the loom, said lubricant pressure surges actuating said pump, the reciprocating pump being connected to a lubricant storage container by a third conduit, whereby actuation of said pump by said lubricating system of said loom during loom operation pumps and meters the required quantity of lubricant from said container through said first and second conduits into said hollow shaft of said roller body.

* * * * *